US006876137B2

(12) United States Patent
Würsching et al.

(10) Patent No.: US 6,876,137 B2
(45) Date of Patent: Apr. 5, 2005

(54) DISCHARGE LAMP WITH DISCHARGE TUBE FIXTURE ARRANGEMENT AND METHOD FOR MANUFACTURING THE SAME

(75) Inventors: István Würsching, Budapest (HU); Erzsébet Cserteg, Budapest (HU); Zoltán Nagy, Gyula (HU); József Fülöp, Budapest (HU)

(73) Assignee: General Electric Company, Schenectady, NY (US)

( * ) Notice: Subject to any disclaimer, the term of this patent is extended or adjusted under 35 U.S.C. 154(b) by 102 days.

(21) Appl. No.: 10/455,867

(22) Filed: Jun. 6, 2003

(65) Prior Publication Data

US 2004/0140749 A1 Jul. 22, 2004

(30) Foreign Application Priority Data

Jan. 16, 2003 (HU) ..... 0300150

(51) Int. Cl.[7] ..... H01J 5/48; H01J 5/50

(52) U.S. Cl. ..... 313/318.08; 313/318.01; 313/318.09; 362/217; 362/219; 362/225; 439/230; 439/936

(58) Field of Search ..... 313/318.08, 318.09, 313/318.01; 362/217, 225, 219; 439/230

(56) References Cited

U.S. PATENT DOCUMENTS 5,697,697 A 12/1997 Cserteg et al.
5,772,310 A * 6/1998 Cserteg et al. ..... 362/225

* cited by examiner

*Primary Examiner*—Joseph Williams
*Assistant Examiner*—Anthony J. Canning
(74) *Attorney, Agent, or Firm*—Fay, Sharpe, Fagan, Minnich & McKee, LLP

(57) ABSTRACT

There is provided a low pressure discharge lamp, which comprises a discharge tube, a lamp base holding the discharge tube, and a base cap (6) for covering the lamp base. The base cap (6) also provides mechanical support to the discharge tube. The base cap (6) comprises tube openings (10) for receiving end parts of the discharge tube. The base cap (6) further comprises an adhesive space (14) adjacent to a tube opening (10), the adhesive space containing an amount of adhesive. The adhesive space (14) is open toward the discharge tube. The adhesive contained in the adhesive space (14) adheres to an end part of the discharge tube and thereby fixes the discharge tube to the base cap (6). The base cap comprises at least one upper transversal member (31) and at least one lower transversal member (32). The transversal members (31,32) extend substantially in a plane parallel to a plane of the tube opening (10) adjacent to the adhesive space (14). The upper and lower transversal members (31,32) limit the adhesive space (14) at least partly. There is also provided a method for manufacturing a discharge lamp with a base cap (6) described. In the method, the adhesive space is at least partly limited with the upper and lower transversal members. According to the method, ends of the discharge tube are inserted into the tube openings (10) of the base cap (6). An amount of adhesive is fed in the adhesive space (14), and the adhesive is forced to spill out from the adhesive space (14) and to contact the ends of the discharge tube. The adhesive is allowed to adhere to an end part of the discharge tube and thereby the discharge tube is fixed to the base cap (6). A base cap (6) having an upper and lower transversal member (31,32) as above is also claimed.

17 Claims, 5 Drawing Sheets

Fig. 2
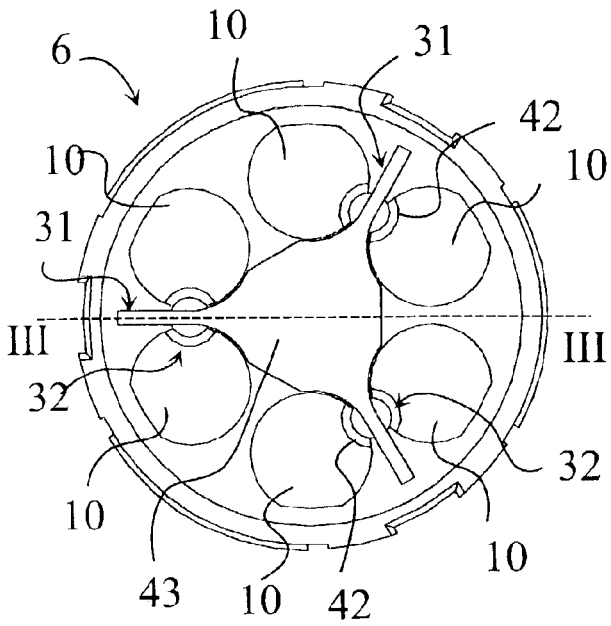
Fig. 3
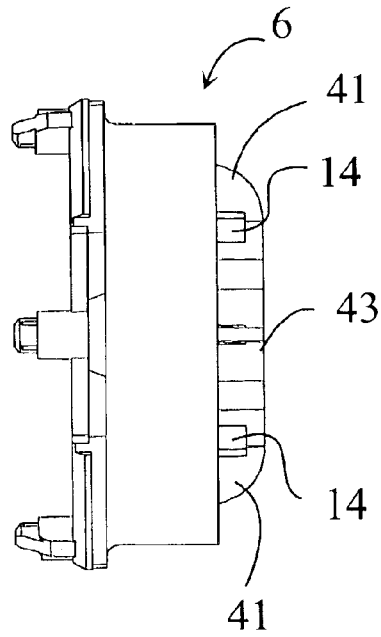
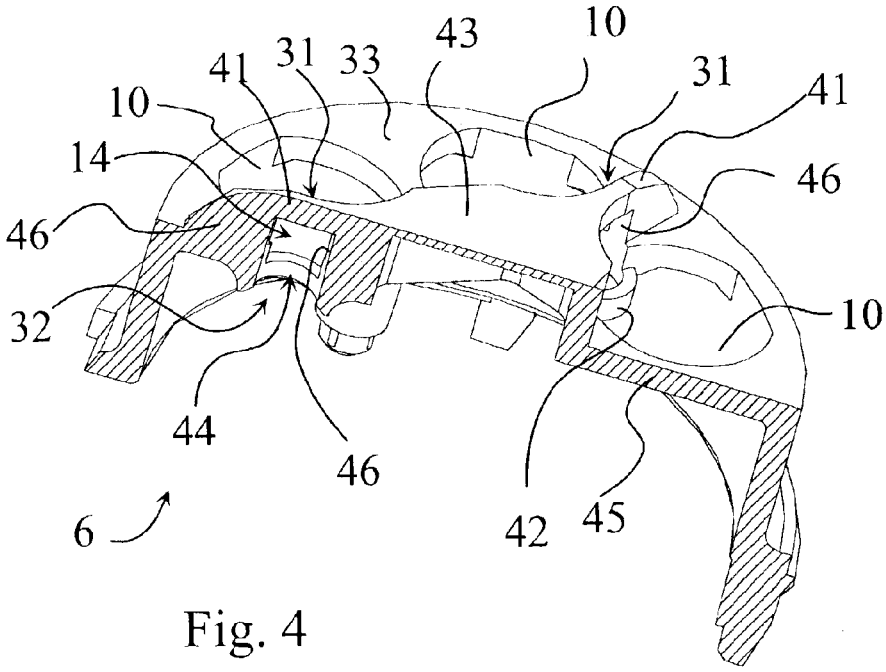
Fig. 4

DISCHARGE LAMP WITH DISCHARGE TUBE FIXTURE ARRANGEMENT AND METHOD FOR MANUFACTURING THE SAME

BACKGROUND OF THE INVENTION

This invention relates to a discharge lamp with a discharge tube fixture arrangement. The invention further relates to a method for manufacturing a discharge lamp utilising such a fixture arrangement.

A wide variety of low pressure discharge lamps are known in the art. A large portion of the low pressure lamps on the market are so-called compact lamps, which means that they are intended to replace traditional incandescent bulbs. For this reason, compact lamps tend to have a discharge tube arrangement with approximately similar dimensions as those of traditional incandescent lamps. In many instances, the electric contacts of compact lamps are provided with traditional screw-in sockets, which form part of a lamp base. The lamp base normally houses the control gear (electronic ballast) of the discharge tubes, and provides a mechanical support for the discharge tube of the compact lamp. In a common discharge tube arrangement, the discharge tube is mechanically fastened to a cap of the lamp base, with the ends of the discharge tube being inserted into openings on the cap, also termed as a base cap.

In order to achieve a proper fastening of the discharge tube to the lamp base, various schemes are known. Older solutions proposed the use of cement, which is a traditional technology for fastening glass bulbs to the lamp base. This cement is in some cases based on artificial resin, which swells when baked and binds the glass body and the plastic cap to each other by creating a tensioning force between a part of the cap suitably designed and the wall of the glass body. In other cases this material is some kind of glue, which sets when affected by humidity or heat, and binds the glass body to the base cap, which is mostly made of plastic. The lamp's mechanical strength must satisfy standards and requirements of reliability and safety, and customer expectations during the whole lifetime of the lamp, and even beyond its lifetime. The lamp should be designed to prevent accidents even during a replacement. With the reduction in size of the compact lamps it is more and more difficult to use artificial resin based cement, since there is not enough space between the edges of the glass tubes and the internal wall of the cap for the cement to be placed, heated to a specified temperature and swell. More recently, the use of flexible adhesive (also commonly termed as glue) became known. Such an adhesive is applied to the ends of the discharge tube on the internal side of the base cap, and provides a mechanical connection between the discharge tube and the base cap. If glue is used, then only those glue types can be considered that are resistant to relatively high temperatures and UV radiation. Glue types that satisfy these requirements are the silicon based, thus flexible glue types. A glass body fixed with flexible glue possesses the necessary strength against mechanical stresses like drawing, twisting, bending, but cannot be used with the known plastic caps, since these do not provide the adequate surface size and shape necessary for bonding. For example, U.S. Pat. No. 5,697,697 teaches the use of either cement or adhesive. The base cap of the lamp base is provided with internal ribs, which latter define an adhesive space for receiving an amount of adhesive. The base cap or base plate is suitable for receiving either cement or adhesive.

This known fixture arrangement is suitable when the discharge tube is inserted relatively deeply into the lamp base, so that the ends of the discharge tube prortudes well below the level of the base plate. On the other hand, some problems remain. For example, the placing the glue on the inside of the base plate largely prevents the pulling out of the discharge tube, but provides insufficient protection against forces which push the discharge tube towards the inside of the lamp base.

A similar fixture arrangement is described in U.S. Pat. No. 5,772,310. In this known arrangement the base plate is equipped with a pair of ribs which guide the adhesive towards those openings which receive the ends of the discharge tubes.

Though the above solutions make it possible to attach a discharge tube mechanically to the base cap, other problems remain. Particularly, it is problematic to provide a suitable adhesive joint between the base cap and the discharge tube when the discharge tube does not extend very deeply into the openings of the base cap. This is generally the case with small compact lamps where the discharge tube is covered with an additional envelope, mostly for aesthetic reasons. In this case it is desirable to lift the discharge tube from the lamp base as much as possible, so that no or minimal light is shaded by the lamp base. Because the additional envelope is generally opaque, it does not matter that the discharge tube ends are not covered completely by the base plate. It is often more important to keep the volume of the lamp base close to size of those of traditional incandescent lamps, which again dictates that the discharge tubes should be lifted from the lamp base to the maximum possible extent.

Therefore, there is a need for a lamp with a fixture arrangement and a manufacturing method which provides a satisfactory mechanical joint between the ends of the discharge tube, by providing sufficient resistance against a pushing force acting on the discharge tube, and directed towards the inside of the lamp base. It is sought to provide an arrangement and method which, beside offering the reqired mechanical support, is relatively simple and which does not require expensive components and complicated manufacturing facilities, and which may be integrated into various types of existing production lines in a straightforward manner.

SUMMARY OF THE INVENTION

In an embodiment of the present invention, there is provided a low pressure discharge lamp, which comprises a discharge tube, a lamp base holding the discharge tube, and a base cap for covering the lamp base. The base cap also provides mechanical support to the discharge tube. The base cap comprises tube openings for receiving end parts of the discharge tube. The base cap further comprises an adhesive space adjacent to a tube opening, the adhesive space containing an amount of adhesive. The adhesive space is open toward the discharge tube. The adhesive contained in the adhesive space adheres to an end part of the discharge tube and thereby fixes the discharge tube to the base cap. The base cap comprises at least one upper transversal member and at least one lower transversal member. The transversal members extend substantially in a plane parallel to a plane of the tube opening adjacent to the adhesive space. The upper and lower transversal members limit the adhesive space at least partly.

According to another aspect of the invention, there is provided a method for manufacturing a discharge lamp, where the discharge lamp comprises a discharge tube, a lamp base holding the discharge tube, and a base cap for covering the lamp base and for providing mechanical support to the discharge tube. The base cap comprises tube openings for receiving end parts of the discharge tube and an adhesive space adjacent to a tube opening, for receiving an amount of adhesive. The base cap also comprises an opening from the adhesive space towards the discharge tube. The method comprises the step of providing at least one upper transversal member and at least one lower transversal member on the base cap, the transversal members extending substantially in a plane parallel to a plane of the tube opening adjacent to the adhesive space. In the method, the adhesive space is limited with the upper and lower transversal members. According to the method, ends of the discharge tube are inserted into the tube openings of the base cap. An amount of adhesive is fed in the adhesive space, and the adhesive is forced to spill out from the adhesive space and to contact the ends of the discharge tube. The adhesive is allowed to adhere to an end part of the discharge tube and thereby the discharge tube is fixed to the base cap.

According to another aspect of the invention, there is also provided base cap for covering a lamp base of a discharge lamp. The base cap comprises tube openings for receiving end parts of a discharge tube. The base cap further comprises an adhesive space adjacent to a tube opening, for receiving an amount of adhesive. The adhesive space is open toward the adjacent tube opening. The base cap further comprises at least one upper transversal member and at least one lower transversal member. The transversal members extend substantially in a plane which is parallel to a plane of the tube opening adjacent to the adhesive space. The upper and lower transversal members limit the adhesive space at least partly.

The disclosed method and fixture arrangement partly ensures that the adhesive is confined to the adhesive space, and the adhesive is forced to contact the discharge tubes in the tube openings. Partly, the transversal members provide a stable mechanical support for the adhesive in the adhesive space, which prevents the detachment of the adhesive from the base plate, under the effect of a pulling or a pushing force. Further, the confinement of the adhesive to the adhesive space by the transversal members results in a relatively small amount of adhesive being used for the discharge lamp. The proposed base cap is easily manufactured with molding, and the dosing and the feeding of the adhesive into the adhesive space can be made very precisely. Generally, mechanically strong bonding without causing glass strain can be achieved by the proposed fixture arrangement. The suggested design of the base cap provides for sufficient surface size and form, so that a relatively small amount of glue may be inserted with an approximately uniform thickness between the glass and the plastic cap. The resulting mechanical bond ensures that the glass body would not significantly move, even when the discharge tube body is twisted, pulled in the direction of the axis, or pressed into the lamp housing. As a result of the proposed bonding technology and the cap design, the place of gluing is near the seal of the glass body, which makes it possible to substantially eliminate plastic parts fitting to the external enveloping surface of the glass body. Thus the useful luminous surface of the lamp may increase, in spite of the fact that the size of the finished lamp is smaller and becomes similar to an incandescent lamp.

BRIEF DESCRIPTION OF DRAWINGS

The invention will be now described with reference to the enclosed drawings, where FIG. 2 is a top view of a base cap used in the lamp of FIG. 1, FIG. 3 is a side view of the base cap shown in FIG. 2, FIG. 4 is a perspective view of a base cap of FIGS. 2 and 3, cut along the plane III—III in FIGS. 2 and 3, illustrating the adhesive space in the base cap.

DETAILED DESCRIPTION OF THE INVENTION

Figure 1:
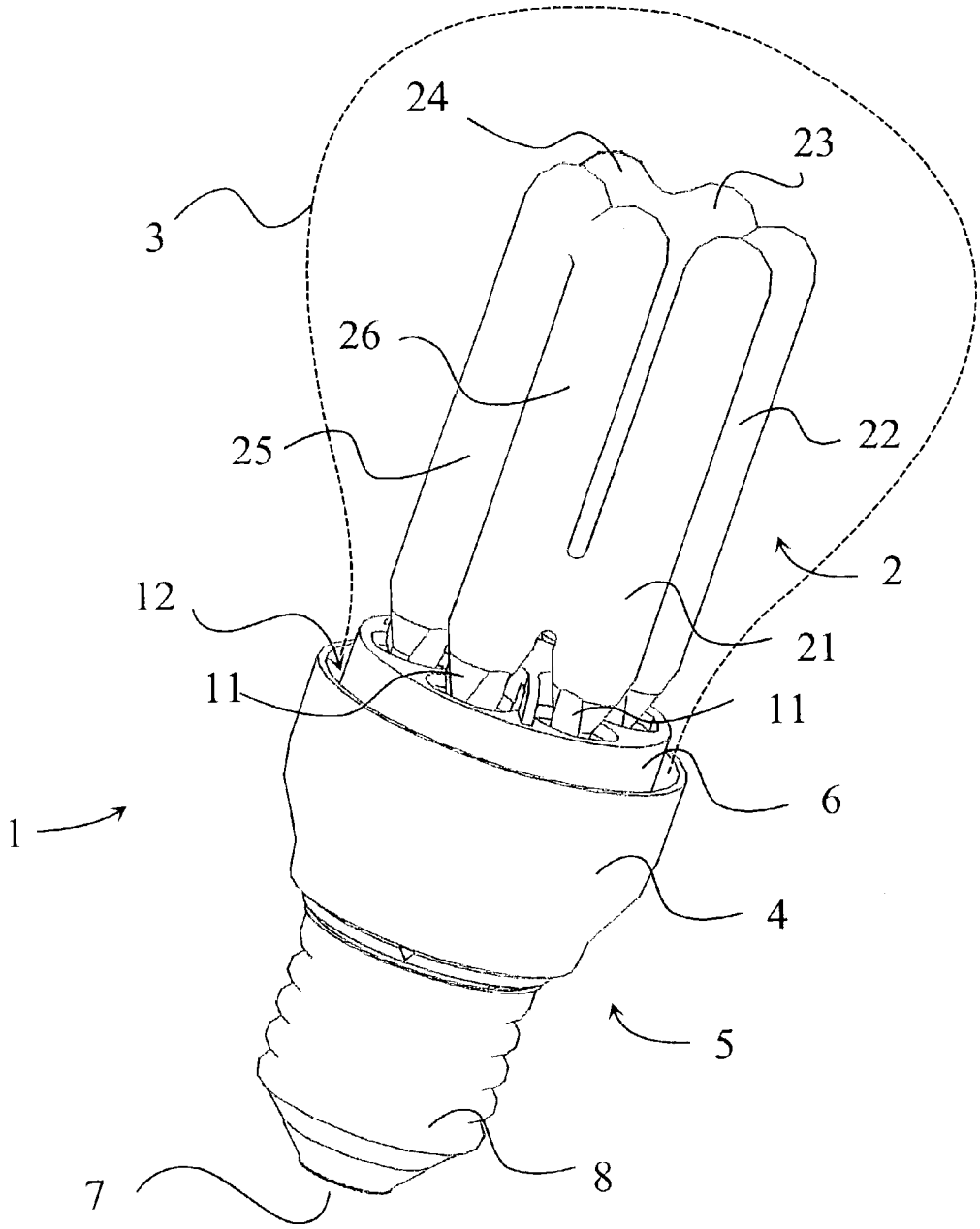
FIG. 1 is a perspective view of a low pressure discharge lamp with six straight discharge tube sections.
Figure 5:
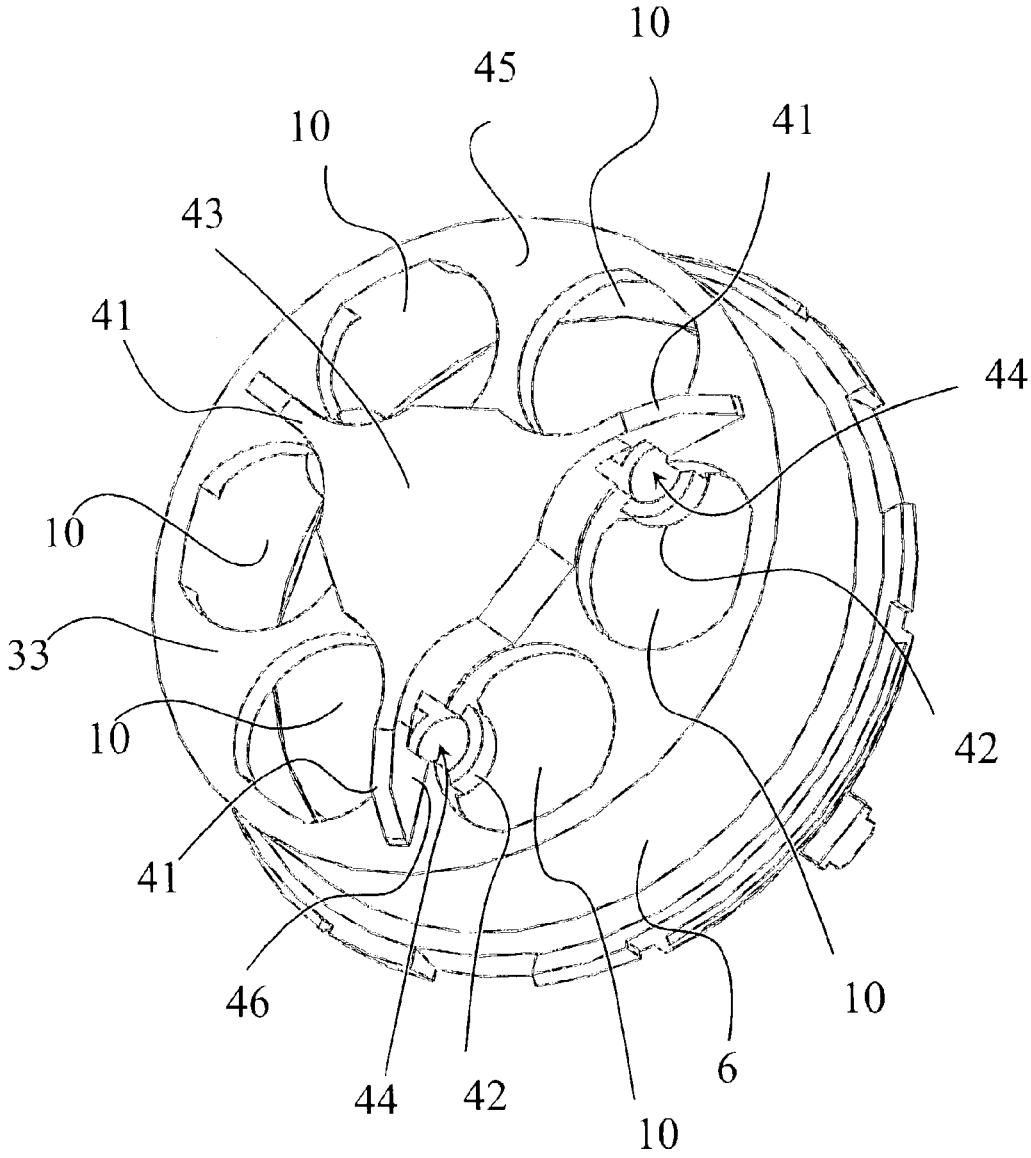
FIG. 5 is another enlarged, perspective view of a complete base cap of FIGS. 2 and 3, as seen from the outside of the lamp base.

Referring now to FIG. 1, there is shown a low pressure discharge lamp 1 having a discharge tube 2. The discharge tube 2 is constituted in this example by six straight discharge tube sections 21 to 26. Such a discharge lamp 1 is also commonly known as a compact discharge lamp or compact light tube, or simply compact lamp, and it is well known in the art.

The discharge lamp 1 has a lamp base 5. The lamp base 5 holds the discharge tube 2, and also comprises the electric contacts 7,8 of the lamp 1. In the embodiment shown in FIG. 1, the discharge lamp 1 is equipped with traditional screw contacts. The discharge lamp 1 shown in FIG. 1 is also equipped with an external translucent envelope 3, which is indicated with dashed line only. When the envelope 3 is in place, the discharge lamp 1 resembles a traditional incandescent ligth bulb.

The lamp base 5 is surrounded by a lamp base housing 4, which is covered by a base cap 6. The base cap 6 is attached to the lamp base housing 4, and it also provides mechanical support to the discharge tube 2. This means that the discharge tube 2 is mechanically fastened to the base cap 6. The invention concerns the manner in which the discharge tube 2 is attached to the base cap 6, and it is explained with reference to FIGS. 2 through FIG. 9.

In order to provide suitably reliable mechanical support to the discharge tube, the base cap 6 comprises tube openings 10 for receiving end parts 11 of the discharge tube 2. As best seen in FIG. 2, the base cap 6 in this embodiment has six tube openings 10, corresponding to the six tube sections 21 to 26. Such tube openings 10 determine more or less exactly the location of the discharge tube 2 relative to the lamp base 5. The discharge tube 2 is glued to the base cap 6. For this purpose, the base cap 6 comprises adhesive spaces 14 adjacent to the tube openings 10. These adhesive spaces 14 receive a certain amount of adhesive 16, which will be explained more in detail with reference to FIGS. 6 to 9. As best seen in FIG. 4, the adhesive spaces 14 are open toward the discharge tube 2. In the shown embodiment, the adhesive spaces 14 are also open toward the tube openings 10, so that when the end parts 11 of the discharge tube 2 are inserted into the tube openings 10, the adhesive in the adhesive space 14 may contact and adhere to the end parts 11 of the discharge tube 2. In this manner, the adhesive 16 (see FIGS. 8 and 9) is able to fix the discharge tube 2 to the base cap 6. In the shown embodiment, the adhesive space 14 partly overlaps with the tube openings 10, but it is also possible to form the adhesive space in a plane which is slightly above or below the plane of the tube openings 10.

The base cap 6 further comprises an upper transversal member 31 and at least one lower transversal member 32.

The term "upper" and "lower" refer to the mounted position of the base cap 6 when the discharge lamp 1 is positioned upright, so that the discharge tube 2 is at the top and the lamp base 5 is below, similarly to the position shown in FIG. 1. These transversal members 31,32 extend substantially in a plane parallel to a plane of the tube opening 10 adjacent to the adhesive space 14, with other words, they are substantially perpendicular to the main longitudinal axis of the lamp. Practically, in the upright position of the discharge lamp 1, the transversal members 31,32 are substantially horizontal. The role of the upper transversal member 31 and the lower transversal member 32 is to limit the adhesive space 14. Particularly, it is foreseen to limit the adhesive space 14 both from the outside and the inside of the lamp base 5, respectively. Here, the terms "outside" and "inside" refer to the base cap 6 when it is mounted in the lamp base 5. In this mounted position the surface 33 of the base cap 6 is facing the outside and surface 34 of the base cap 6 is facing the inside of the lamp base 5 (see FIG. 4).

In the embodiment shown in FIGS. 2 to 5, the upper transversal member 31 is a rib 41. This rib 41 may extend from a central protrusion 43 of the base cap 6 towards a peripheral portion of the base cap 6, as shown in the figures, but may also be formed independently thereof. As seen in the figures, the base cap 6 has three ribs 41 arranged substantially symmetrically, and connecting to a common central protrusion 43. This arrangement of the ribs 41 and the central protrusion 43 lends a relatively stiff structure to the base cap 6, particularly its base plate 45, and for this reason, the base cap 6 provides adequate mechanical support to the discharge tube 2. In the shown embodiment, the lower transversal member 32 is a ring member 42. This ring member 42 is provided with a central feed bore 44 for feeding an adhesive into the adhesive space 14. The feed bore 44 communicates with the adhesive space 14, for the purposes explained below.

Figure 6:
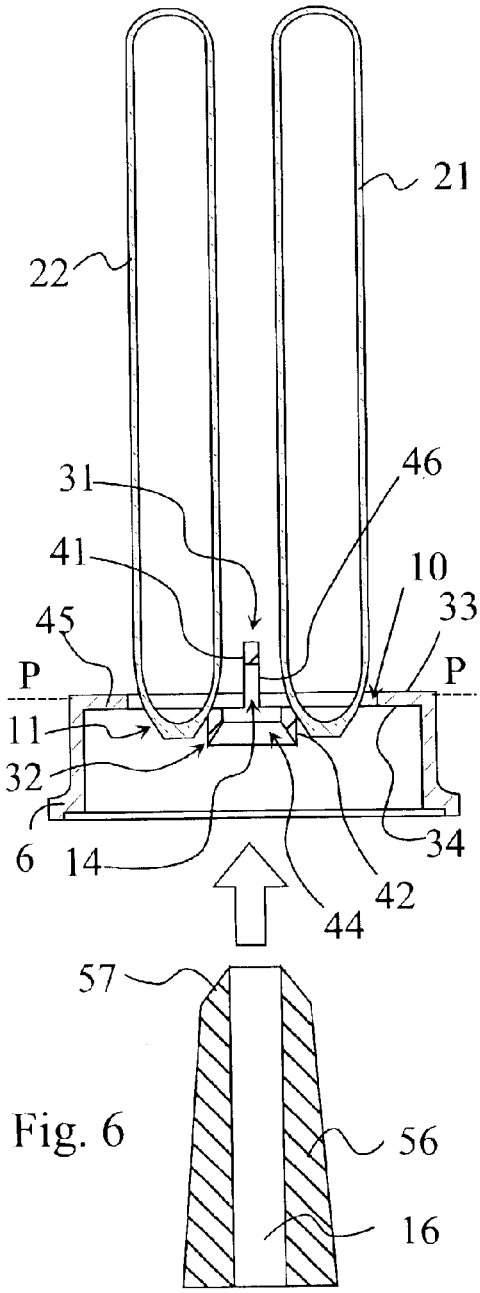
FIGS. 6 to 9 illustrate the feeding of adhesive into the adhesive space of the lamp base shown in FIGS. 2 to 5, during the manufacture of the discharge lamp.

As best seen in FIGS. 4 and 6, the feed bore 44 of the ring member 42 is tapered towards the adhesive space 14. This tapering serves for guiding an adhesive feed nozzle 56 into the feed bore 44, when the adhesive 16 is fed into the adhesive space 14, as shown with reference to FIGS. 6 to 9.

In the shown embodiment, the adhesive space 14 is in the same plane as the tube openings 10, and, as mentioned above, the three adhesive spaces 14 positioned between a pair of tube openings 10, slightly overlaps with the adjacent tube openings 10. Here, the upper and lower transversal members 31,32 are located relative to the lamp base 5 externally and internally, respectively. With other words, the upper transversal member 31, which is presently constituted by the rib 41, is external to the lamp base 5, in the sense that the lamp base 5 is considered to be bounded by the base plate 45 of the base cap 6. For the same reason, the lower transversal member 32, which is constituted in this embodiment by the ring member 42, is considered to be within the lamp base 5. In this manner the adhesive spaces 14 are located substantially in the plane of the base plate 45 of the base cap 6. Therefore, the adhesive spaces 14 in this embodiment are also limited laterally by a plane member of the base cap 6, where the plane member comprises the tube openings 10. This plane member is constituted here by the base plate 45 (best seen in FIG. 4). The term "laterally" is to be construed as in a horizontal direction when the base cap 6 is mounted in the lamp base 5 and the discharge lamp 1 is in the upright position as explained above. However, the adhesive spaces 14 are also limited laterally by the lower portions 46 of the ribs 41. As will be explained with reference to FIGS. 6 to 9, the remaining parts of the adhesive spaces 14 are limited by the discharge tube 2 when the latter is inserted into the tube openings 10 of the base cap 6. In this manner, the adhesive spaces 14 are substantially completely surrounded by either mechanical barriers or by the objects which need to be glued into position, so that an undesired spill out of the adhesive into the lamp base or onto the external surface 33 of the base cap 6 is largely prevented.

The adhesive space 14 may be located between multiple tube openings 10, so that the adhesive spaces 14 may communicate with the adjacent tube openings 10. In the shown embodiment, the adhesive spaces 14 are located symmetrically between two tube openings 10. However, it is also possible to form a larger adhesive space which could communicate with a larger number tube openings, or which is open towards more discharge tube sections, but this would require the use of more adhesive.

Turning now to FIGS. 6 to 9, there are shown the basic steps of a method for manufacturing a discharge lamp, such as the discharge lamp 1 shown in FIG. 1. As explained above, the method is applicable for the manufacturing of such discharge lamps which comprise a discharge tube 2, a lamp base 5 which holds the discharge tube 2, and a base cap 6 for covering the lamp base 5 and for providing mechanical support to the discharge tube. The base cap 6 comprises tube openings 10 for receiving end parts of the discharge tube 2, as explained above. The proposed method makes use of an adhesive space 14, which is adjacent to a tube opening 10. The adhesive space 14 may directly overlap with the tube opening 10, but may also be distinct from it. The role of the adhesive space 14 is to receive an amount of adhesive. An opening is provided from the adhesive space 14 towards the discharge tube 2.

In the proposed method, at least one upper transversal member 31 and at least one lower transversal member 32 are provided on the base cap 6. As explained above, these transversal members 31,32 extend substantially in a plane parallel to a plane of the tube opening 10 adjacent to the adhesive space 14. In the embodiment shown in FIGS. 6 to 9, the transversal members 31,32 extend in a plane parallel to the plane P of the base plate 45 of the base cap 6. The transversal members 31,32 are thus limiting the adhesive space 14 at least partly. The adhesive space 14 is thus limited both from the outside and the inside of the lamp base 5.

The gluing of the discharge tube 2 starts with the insertion of the ends 11 of the discharge tube sections 21,22 into the tube openings 10 of the base cap 6. This is illustrated in FIG. 6. As seen in FIG. 6, the ends 11 of the discharge tube sections 21,22 does not extend very deeply into the base cap 6, and yet the proposed fixture arrangement ensures a stable mounting of the discharge tube 2.

Figure 7:
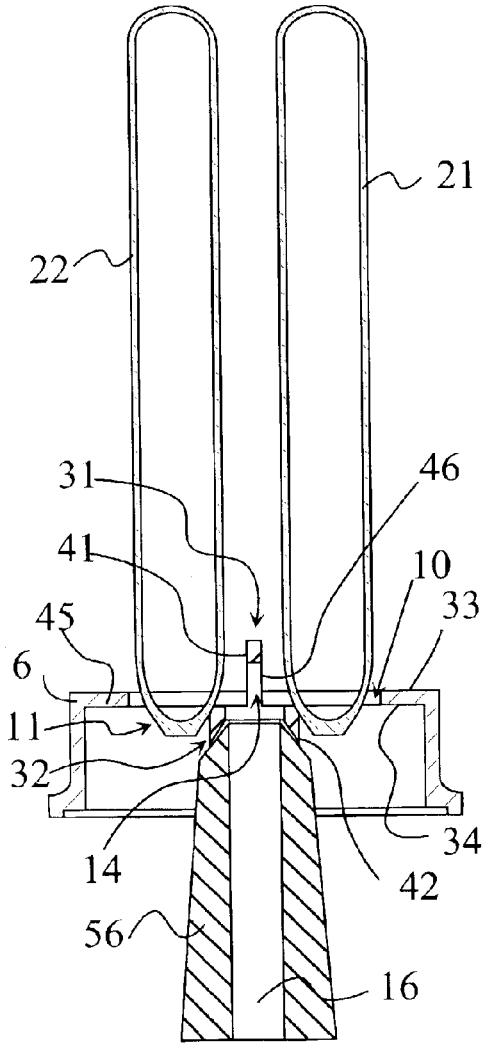
Figure 8:
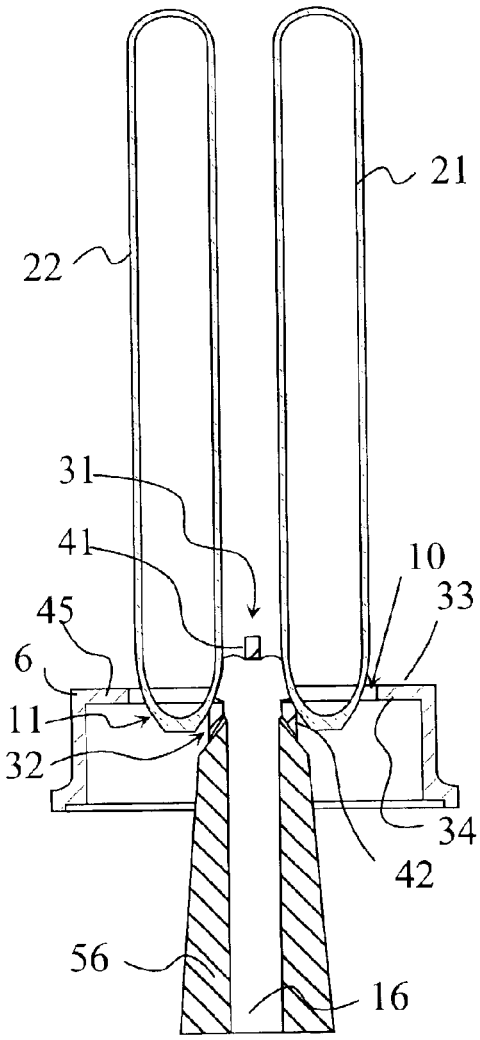
Figure 9:
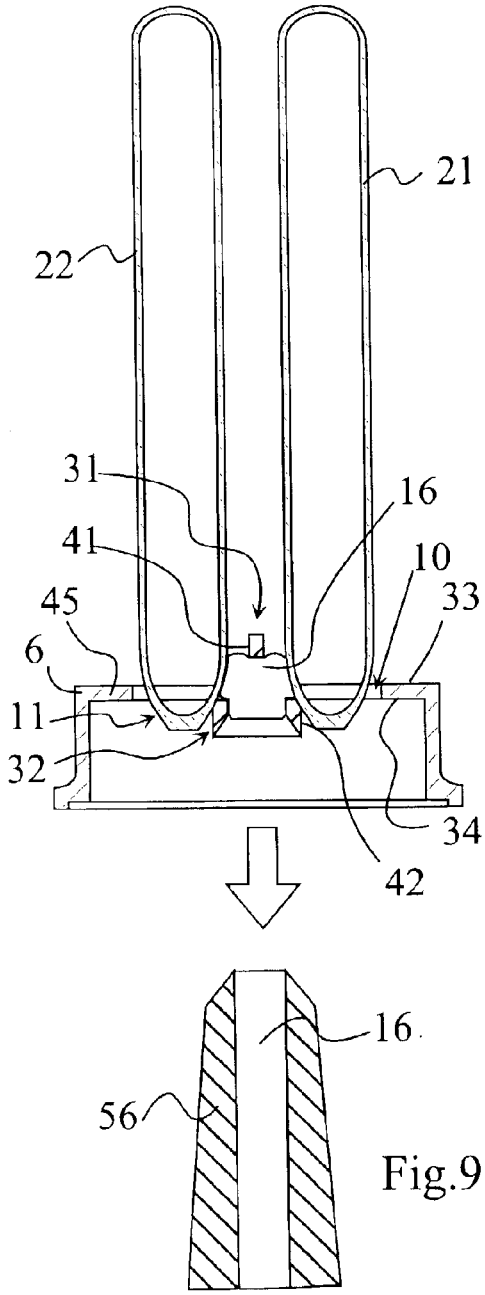

Next, as shown in FIGS. 7 and 8, an amount of adhesive 16 is fed into the adhesive space 14 confined between the upper and lower transversal members 31,32, the base plate 45 and the discharge tube sections 21,22. The adhesive 16 is fed into the adhesive space 14 through the feed bore 44 (see also FIG. 5) with the help of the feed nozzle 56, which has a tapered end 57 fitting to the taper of the feed bore 44. As the fluid—preferably gel-like—adhesive 16 is injected into the adhesive space 14 under a certain overpressure by a suitable apparatus (not shown), the fluid adhesive is forced to spill out from the adhesive space 14 and to contact the ends of the discharge tube 2, in the present case the ends of the tube sections 21,22.

Following this, the adhesive 16 is allowed to adhere to the end parts of the discharge tube sections 21,22. If necessary, the setting or hardening of the adhesive may be facilitated by known methods, such as a temperature or UV treatment or the like. However, before the adhesive 16 is set, the feed nozzle 56 is withdrawn from the base cap assembly (see FIG. 9). Only a small amount of adhesive 16 remains in the adhesive space 14, which fixes the discharge tube 2 to the base cap 6. This remaining chunk of the adhesive 16 is firmly locked between the discharge tube sections 2, and the upper and lower transversal members 31,32, in the present case between the rib 41 and the ring member 42. These latter provide good mechanical support to the adhesive 16 against pulling or pushing forces, which would otherwise tend to loosen the adhesive bond between the base cap 6 and the remaining adhesive 16.

As shown in FIGS. 6 to 9, by locating the adhesive space 14 between multiple tube openings 10, presently between two tube openings, it is possible to feed the adhesive 16 with a single feeding action to multiple tube ends. Preferably, the adhesive space 14 is located symmetrically between two tube openings 10, because in this manner the least amount of adhesive is necessary, and the resulting adhesive bond will be also more or less symmetric.

The fact that the rib 41 serving as the upper transversal member 31 slightly extends from the general plane of the base plate 45, also contributes to the mechanical stability of the fixture arrangement. The central protrusion 43 supports the ribs 31 from the "dead space" between the discharge tube sections 21–26, but does not cover out any light being emitted from the lower parts of the discharge tube sections 21–26. Further, the base cap 6 is designed so that a slot 12 is formed between the upper edge of the lamp base housing 4 and the base cap 6, which slot 12 may receive the lower rim of the envelope 3 (see FIG. 1).

The invention is not limited to the shown and disclosed embodiments, but other elements, improvements and variations are also within the scope of the invention. It is clear for those skilled in the art that the same discharge tube fixture arrangement may be applied to other types of low-pressure discharge lamps, and not only to lamps having straight discharge tube sections as shown in FIG. 1. For example, the proposed method is equally suitable for the manufacture of helical lamps or lamps with other configurations.

What is claimed is:

1. A low pressure discharge lamp, comprising a discharge tube, a lamp base holding the discharge tube, a base cap for covering the lamp base and for providing mechanical support to the discharge tube, the base cap comprising tube openings for receiving end parts of the discharge tube, the base cap further comprising an adhesive space adjacent to a tube opening, the adhesive space containing an amount of adhesive, and further the adhesive space being open toward the discharge tube and the adhesive contained in the adhesive space adhering to an end part of the discharge tube and thereby fixing the discharge tube to the base cap, the base cap further comprising at least one upper transversal member and at least one lower transversal member, the transversal members extending substantially in a plane parallel to a plane of the tube opening adjacent to the adhesive space, the upper and lower transversal members limiting the adhesive space at least partly.

2. The discharge lamp of claim 1, in which the upper transversal member is a rib extending from a central protrusion of the base cap towards a peripheral portion of the base cap.

3. The discharge lamp of claim 1, in which the lower transversal member is a ring member with a central feed bore, the feed bore communicating with the adhesive space.

4. The discharge lamp of claim 3, in which the feed bore is tapered towards the adhesive space.

5. The discharge lamp of claim 1, in which the adhesive space is in the same plane as the tube opening, and the upper and lower transversal member is located relative to the lamp base externally and internally, respectively.

6. The discharge lamp of claim 5, in which the adhesive space is limited laterally by a plane member of the base cap, the plane member comprising the tube opening.

7. The discharge lamp of claim 2, in which the adhesive space is limited laterally by a lower portion of the rib.

8. The discharge lamp of claim 1, in which the adhesive space is located between multiple tube openings, and the adhesive space communicates with the adjacent openings.

9. The discharge lamp of claim 8, in which the adhesive space is located between two tube openings.

10. The discharge lamp of claim 8, in which the upper and lower transversal members are limiting the adhesive space from the outside and the inside of the lamp base, respectively.

11. A method for manufacturing a discharge lamp, the discharge lamp comprising a discharge tube, a lamp base holding the discharge tube, a base cap for covering the lamp base and for providing mechanical support to the discharge tube, the base cap comprising tube openings for receiving end parts of the discharge tube and an adhesive space adjacent to a tube opening, for receiving an amount of adhesive, and comprising an opening from the adhesive space towards the discharge tube, the method comprising the steps of:

providing at least one upper transversal member and at least one lower transversal member on the base cap, the transversal members extending substantially in a plane parallel to a plane of the tube opening adjacent to the adhesive space, and limiting with the upper and lower transversal members the adhesive space at least partly, inserting ends of the discharge tube into the tube openings of the base cap, feeding an amount of adhesive in the adhesive space, and forcing the adhesive to spill out from the adhesive space and to contact the ends of the discharge tube, allowing the adhesive to adhere to an end part of the discharge tube and thereby fixing the discharge tube to the base cap.

12. The method of claim 11, further comprising the step of providing a feed bore through the lower transversal member, the feed bore communicating with the adhesive space, and feeding the adhesive into the adhesive space through the feed bore.

13. The method of claim 11, further comprising the step of locating the adhesive space between multiple tube openings, and feeding the adhesive with a single feeding action to multiple tube ends.

14. The method of claim 13, further comprising the step of locating the adhesive space between two tube openings.

15. The method of claim 11, in which a flexible adhesive is used.

16. A base cap for covering a lamp base of a discharge lamp, the base cap comprising:

tube openings for receiving end parts of a discharge tube, the base cap further comprising an adhesive space adjacent to a tube opening, for receiving an amount of adhesive, and further the adhesive space being open toward the adjacent tube opening, the base cap further comprising at least one upper transversal member and at least one lower transversal member, the transversal members extending substantially in a plane parallel to a plane of the tube opening adjacent to the adhesive space, the upper and lower transversal members limiting the adhesive space at least partly.

17. The base cap of claim 16, in which the upper and lower transversal members are limiting the adhesive space from the outside and the inside of the lamp base, respectively.

* * * * *